United States Patent [19]

Soth et al.

[11] 4,360,156

[45] Nov. 23, 1982

[54] FLUID METERING AND SPRAYING

[75] Inventors: J. Michael Soth, Urbandale; Roy E. Pack, Jr., Winterset, both of Iowa

[73] Assignee: Delavan Corporation, West Des Moines, Iowa

[21] Appl. No.: 153,837

[22] Filed: May 27, 1980

[51] Int. Cl.[3] ..... B05B 17/04

[52] U.S. Cl. ..... 239/11; 239/462; 239/466; 239/493; 239/600; 239/601

[58] Field of Search ..... 239/11, 462, 466, 469, 239/488, 489, 491, 493, 589, 590.5, 601, 600

[56] References Cited

U.S. PATENT DOCUMENTS

| | | | |
|---|---|---|---|
| 2,307,206 | 1/1943 | Fischer | 239/493 |
| 2,643,915 | 6/1953 | Pieroni | 239/493 |
| 2,703,260 | 3/1955 | Olson et al. | 239/462 |
| 2,762,657 | 9/1956 | Wilson | 239/493 |
| 2,823,954 | 2/1958 | Olson | 239/493 |
| 3,100,084 | 8/1963 | Biber | 239/493 |
| 3,672,578 | 6/1972 | Wayne | 239/590 |

FOREIGN PATENT DOCUMENTS

| | | | |
|---|---|---|---|
| 1017113 | 10/1957 | Fed. Rep. of Germany | 239/488 |

*Primary Examiner*—Bruce H. Stoner, Jr.
*Assistant Examiner*—Michael J. Forman
*Attorney, Agent, or Firm*—Lockwood, Dewey, Alex & Cummings

[57] ABSTRACT

In an orifice and nozzle for the passage of fluid which may contain solid particulates as contaminants, the orifice and nozzle includes an opening which is rectangular in a cross-sectional plane perpendicular to the axis of the fluid flow. The rectangular opening has a ratio of minimum width to minimum depth, or vice versa, of less than approximately 1.5, and preferably 1.0, and a ratio of the length of the opening to the lesser of minimum width and minimum depth of the opening of less than approximately 2.0, and preferably 1.0. The rectangular cross section together with these ratios prevents plugging by the solid contaminants.

28 Claims, 6 Drawing Figures

FLUID METERING AND SPRAYING

BACKGROUND & SUMMARY OF THE INVENTION

The present invention relates to fluid metering and spraying and, more particularly, to orifices for the passage of fluid which may contain solid particulate contaminants and nozzles and methods for metering and dispensing such fluids all of which preclude plugging by the contaminants.

In U.S. Pat. No. 3,672,578 of Alex Wayne, a fluid nozzle is disclosed in which fluid is caused to flow through an elongated passage from which it is injected into a chamber prior to discharge from the discharge orifice of the nozzle. The elongate passage is angularly disposed to cause the fluid to enter the predischarge chamber in a swirling fashion. The elongate passage not only imparts a swirling motion to the fluid in this chamber and upon discharge from the nozzle, but also constitutes an orifice which meters the quantity of fluid discharged from the nozzle and, thereby, determines the capacity of the nozzle.

Nozzles such as disclosed in the aforementioned patent have found wide application as fuel oil burner nozzles for the injection of the fuel oil in metered quantities into oil furnaces. These nozzles operate quite satisfactorily where the flow rate through the nozzles is substantial, particularly where the fuel oil which is being passed through the nozzle has been filtered to remove solid particulate contaminants to the extent that this is possible. However, an increasing demand exists today for fuel oil burner nozzles of substantially lower flow rates or capacities than have been generally used in the past due to the increased usage of fuel conserving structural techniques and increased fuel prices. Moreover, there is a continuing need for such low flow rate nozzles for the heating of small volume residences, such as mobile homes and the like.

Nozzles such as disclosed in the aforementioned patent have been found to be unsatisfactory in such low flow rate applications, for example where the flow rate does not exceed 0.4–0.5 gallon per hour at 100 psi of No. 2 fuel oil. The reason is that even though filters, such as sintered filters, are available for removing the major portion of the solid contaminants in the fuel oil entering the nozzles, such filters still can not remove all of the extremely fine solid particulate contaminants in the micron size ranges. These fine contaminants do not present a problem in the higher flow rate nozzles where the metering passages or orifices are larger because these fine contaminants easily pass through these orifices. However, where the size of the metering passages or orifices are necessarily reduced to obtain the lower fuel oil flow rates and capacities, these fine contaminants which pass through the filter become lodged in the metering passages or orifices and quickly cause them to plug so as to render the nozzle inoperative.

It has been discovered in the present invention that the metering orifices or passages in such low flow rate nozzles may be reduced in size to achieve flow rates at or below the 0.4–0.5 gallon per hour rates if they are configured in a certain manner as herein described and, if they are so configured, they avoid plugging by fine contaminants. Indeed, it has been found that by practicing the principles of the present invention, flow rates of as low as 0.25 gallon per hour at 100 psi with No. 2 fuel oil may be readily obtained without plugging and inoperability of the fuel oil nozzles. Another advantage of the present invention is that these low flow rates may be obtained at a minimum of manufacturing and maintenance expense.

In one principal aspect of the present invention, an orifice for the passage of fluid which may contain solid particulates includes an opening which is substantially rectangular in a cross-section plane perpendicular to the axis of the fluid flow therethrough. The opening has a ratio of minimum width to minimum depth, or vice versa, of less than approximately 1.5, and preferably approximately 1.0, and a ratio of the length of the opening to the lesser of minimum width and minimum depth of the opening of less than approximately 2.0, and preferably approximately 1.0.

In another principal aspect of the present invention, a fluid nozzle having a discharge orifice, a chamber for swirling fluid upstream of the discharge orifice, and second orifice means for introducing the fluid into the chamber and for imparting swirl to the fluid includes the improvement in which the second orifice means includes at least one opening which is smaller in cross section than the discharge orifice and which is substantially rectangular in a cross-sectional plane perpendicular to the axis of the fluid flow through the opening. The opening has a ratio of minimum width to minimum depth, or vice versa, of less than approximately 1.5, and preferably approximately 1.0.

In still another aspect of the present invention, a method of metering fluid which may contain solid particulates includes passing the fluid through an orifice having at least one opening which is substantially rectangular in a cross-sectional plane perpendicular to the axis of the fluid flow through the opening. The opening has a ratio of minimum width to minimum depth, or vice versa, of less than approximately 1.5 and preferably approximately 1.0, and a ratio of length to the lesser of minimum width and minimum depth of less than approximately 2.0, and preferably approximately 1.0.

These and other objects, features and advantages of the present invention will be more clearly understood through a consideration of the following detailed description.

BRIEF DESCRIPTION OF THE DRAWINGS

In the course of this description, reference will frequently be made to the attached drawing in which.

DESCRIPTION OF THE PREFERRED EMBODIMENT

Figure 1:
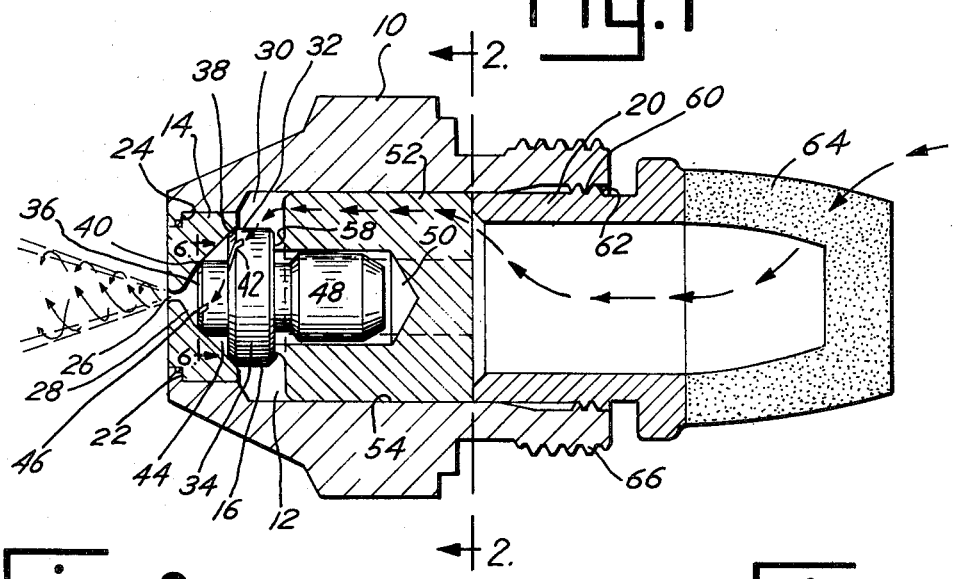
FIG. 1 is a cross-sectioned side elevation view of a preferred embodiment of fluid nozzle constructed in accordance with the principles of the invention.

A nozzle which is constructed in accordance with the principles of the present invention is shown in the drawing. The nozzle generally includes a nozzle body 10 having an elongate passage 12 therein which is open at both ends for receiving an orifice disc 14, a fluid distributor 16, a distributor retainer 18, and an orifice or distributor retaining member 20 which is threaded into the end of the passage 12 for maintaining the various components positioned in place in the nozzle body.

The orifice disc 14 is preferably stepped at 22 to cooperate with a corresponding annular shoulder 24 as shown in FIG. 1 which is formed at one end of the nozzle body to maintain the disc firmly positioned at that end of the nozzle body in the body passage 12. A conventional spray or discharge orifice 26 is formed in the disc and communicates between the external face of the orifice disc and a tapered swirl chamber 28 in the orifice disc in the opposite face of the disc upstream of orifice 26 and adjacent to end 30 of the passage 12.

The fluid distributor 16 is provided with a head 32 at one end thereof. The head 32 preferably includes two portions, a larger diameter portion 34 and a smaller diameter tip portion 36. The leading end of the larger diameter portion 32 is chamfered or tapered at 38 and the leading end of the tip portion 36 is, likewise, chamfered or tapered at 40 to complement and closely fit against the wall of the tapered swirl chamber 28 in the disc. One way to insure that the chamfers 38 and 40 complement each other is to first machine the head 32 to the frusto-conical shape shown in U.S. Pat. No. 3,672,578, and then cut away a portion of the head to define the larger diameter and tip portions 34 and 36 shown in FIG. 1.

One or more passages or grooves 42 are also preferably machined into the forward chamfer 38 of the larger diameter portion 34. These grooves communicate fluid between the passage end 30 and space 44 between the chamfers 38 and 40. The size and number of grooves 42 are not critical to the present invention. They are sufficiently large to insure the free flow of fluid into the space 44 to keep it filled without the danger of plugging of the passages or grooves 42 from contaminants. These passages or grooves 42, together with the tapered wall of chamber 28 of the orifice disc 14, form elongate passages or openings for communicating the fluid to the space 44.

At least one, and preferably two angled fluid flow passages or grooves 46 are also machine cut in the chamfer 40 of the tip portion 36. It is these angled passages 46 which constitute an important feature of the present invention as will be described in more detail later. Like passages 42, angled passages 46, together with the tapered walls of swirl chamber 28 of the orifice disc 14 also form elongate orifices or openings which communicate between the space 44 and the swirl chamber just upstream of the discharge orifice 26.

Figure 2:
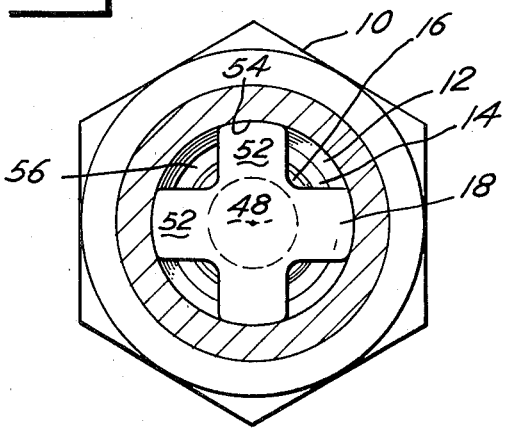
FIG. 2 is a cross-sectioned end elevation view of the nozzle taken substantially along line 2—2 of FIG. 1.
Figure 3:
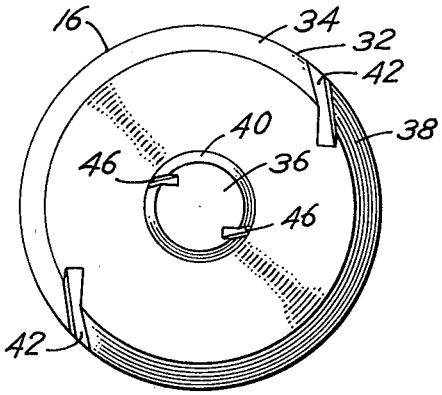
FIG. 3 is an end elevation view of the fluid distributor of the nozzle shown in FIG. 1 and showing the metering orifices of the invention.

The other end of the fluid distributor 16 is preferably provided with a smaller head 48 which is received in axially extending recess 50 in the distributor retainer 18, as shown in FIG. 1. The retainer 18 is preferably formed in a cross section having arms 52 which extend axially of the passage 12 and diametrically span the distance between the internal surface 54 of passage 12, but allow the passage of fluid which is to be sprayed along the retainer, as shown in FIGS. 1 and 2, through channels 56 to the grooved passages 42 in the head 32 of the distributor. An annular lip 58 is preferably formed on the end of the distributor retainer 18 adjacent the head 32 which butts against the rear of the larger diameter portion 34 as shown in FIG. 1 to firmly retain the fluid distributor in place against disc 14.

In order to secure the disc 14, a distributor 16 and distributor retainer 18 in place in passage 12, the internal surface 54 of the passage is internally threaded at 60, as shown in FIG. 1, over a portion of its length and a retaining member 20, which is externally threaded over at least a portion of its length 62, is threaded into the end of the passage 12 until it butts against the end of the distributor retainer 18. As shown in FIG. 1, the distributor retainer 20 may take the form of a filter nipple upon which a suitable filter or strainer 64 is mounted on the external end thereof for filtering the fluid prior to its entry into the nozzle body. Nozzle body 10 may also be threaded externally at 66 for the coupling of a suitable fluid conduit (not shown). A filter of the ceramic or sintered type as shown in FIG. 1 is preferred, particularly in the case of low flow rate nozzles, because such filters are capable of filtering find solid particulate contaminants from the fluid.

Turning now to the particular improvements of the present invention, the angled passages or orifices 46 in the tip portion 36 of the fluid distributor head 32 have been configured in a unique manner which has been found to avoid plugging from fine solid particulate contaminants in the fluid which have passed through any upstream filters and where the nozzle is a low flow rate or capacity nozzle. These passages or orifices 46, of which there are preferably two in number on opposite sides of the tip to impart uniform swirl to the fluid in chamber 28, are substantially smaller in cross section in such low capacity nozzles than the longer angled passages which are shown in the aforementioned U.S. Pat. No. 3,672,578. In fact they are so small that it is difficult to see them with the naked eye. This is because passages 46, like the longer angled passages shown in the aforementioned prior patent, not only induce swirl in the fluid, but they also meter the fluid so as to set the capacity or flow rate of the nozzle. Thus, for the higher flow rate or capacity nozzles, the cross-section of these passages is greater and they are better able to accept and pass fine particulate solid contaminants which may pass through the filter 64. However, as the cross section of angled passages or orifices 46 is reduced to achieve the lower flow rates, it has been found that a funnel packing effect occurs when the nozzle flow rate reaches about 0.5 gallon per hour at 100 psi for No. 2 fuel oil. This funnel packing effect is similar to the plugging which occurs when particulate materials are poured into a funnel. For example, if sugar is poured too rapidly into a funnel, the funnel will plug even though the individual grains of sugar are much smaller than the minimum cross section of the funnel. In the present invention, it has been discovered that such funnel packing effect may be substantially reduced or eliminated altogether by carefully incorporating one or more of the following features in the passages or orifices 46.

Figure 5:
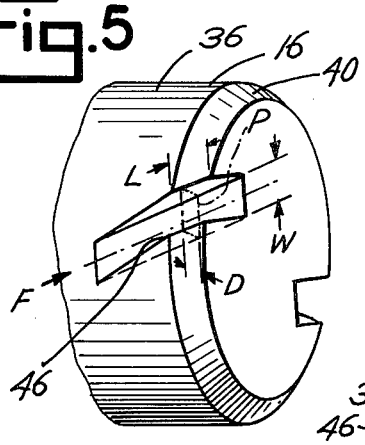
FIG. 5 is a perspective view of the distributor tip also showing the metering orifices.
Figure 6:
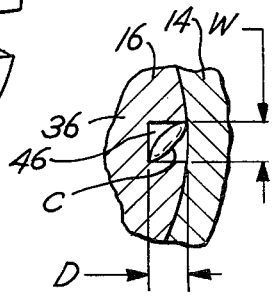
FIG. 6 is a cross-sectioned end elevation view showing a metering orifice or opening in cross-section as viewed substantially along line 6—6 of FIG. 1.

One important feature of the present invention to avoid plugging of the passages is to form the passages such that they are substantially rectangular in cross section in a plane perpendicular to the axis of the fluid flow through the passages or orifices. That plane or cross section is, in effect, the minimum cross section which the solid particulate particles will see as they traverse the passage or orifice and, if the particle will wedge anywhere, it will most likely wedge at this location. By forming the passage of rectangular cross section as shown in FIG. 6, the flow pattern of the fluid through the passage will still be substantially cylindrical in shape even though the passage cross-section has been squared, due to the fluid dynamics of flowing fluids. Thus, appreciable quantities of fluid still will not fill the corners of the rectangular flow passage as the fluid traverses the passage. For this reason, the fluid flow rate through the rectangular opening will remain essentially identical to the flow rate through a cylindrical passage having the same diameter as the minimum depth D and minimum width W of the rectangular passage as shown in FIG. 5. Thus, changing the shape of the passage will not markedly alter the desired low flow rates even though the cross sectional area of the passage may have increased due to making it rectangular.

An important result, however, which has been found to occur when the passage is made rectangular in cross section is that the diagonal distance between its opposite corners is increased over a similar circular cross-sectional passage having a diameter equal to the width W and/or depth D of the rectangular passage. This increased distance enables contaminant particles C, as shown in FIG. 6, and which might have either individual or combined widths greater than the width W or depth D, to pass diagonally through the passage, rather than becoming wedged in the passage.

A second important feature of the present invention is the discovery that there is a relationship between the minimum width W of the passage and the minimum depth D which is least likely to cause plugging. This relationship is that the ratio of the minimum width W of the passage to the minimum depth D, or vice versa, should be less than approximately 1.5, and preferably on the order of 1.0. Thus, it is preferred that the cross section of the rectangular passage which the fluid sees is approximately square. If the ratio is greater, the likelihood of plugging will increase due to the relative narrowness of the passage in one cross sectional dimension for a given desired low flow rate. Conversely, an increase of the narrowest dimension to avoid plugging will result in higher flow rates and, therefore, resort cannot be had to the latter plugging solution where low flow rates are desired.

As referred to herein, the minimum width W of the passage is the width as measured in the plane P as shown in FIG. 5, i.e., the width of the passage or orifice in the portion of the passage where it extends through the chamfer 40. It is in this portion of the passage where the passage is bounded on all four sides due to the contact of the chamfer 40 with the tapered wall of chamber 28 in orifice disc 14. The depth D of the passage or orifice is the depth of the passage measured in the same plane and extending between the inner surface of the overlying orifice disc 14 which forms the fourth wall of the passage and the bottom wall of the passage in the area of the chamfer 40 as shown in FIG. 5. This depth is the minimum depth of the opening.

It has been discovered that the length of the passage may also play an important role in plugging. It has been found that increased length passages, such as shown in the aforementioned U.S. Pat. No. 3,672,578, result in a drag or boundary layer effect in the fluid as it passes through the passage adjacent the passage walls. This boundary layer effect causes the fluid to slow adjacent the walls due to frictional drag and these slowed layers will increase the likelihood of occurrence of the funnel packing effect due to piling up of the small solid particles, any one of which may be substantially smaller than the overall minimum cross section of the passage or orifice. It has been found that reducing the length of the passage such that the ratio of the length L to the lesser of minimum width W and minimum depth D at the plane P to less than approximately 2.0, and preferably about 1.0, substantially reduces the likelihood of such plugging.

The present invention is particularly advantageous in very low flow rate nozzles in which the minimum dimension of width W or depth D does not exceed 0.2 mm. By way of example, fuel oil nozzles having a flow rate of about 0.5 gallons per hour at 100 psi of No. 2 fuel oil will reliably perform when the features of the present invention have been incorporated therein even though the minimum width W and minimum depth D of a pair of orifice openings, such as 46 shown in FIG. 1, is only 0.13–0.15 mm. Even when the flow rate of the No. 2 fuel oil is reduced to 0.25–0.30 gallons per hour at 100 psi by reducing the slot width W and depth D to as little as 0.09 mm, the nozzles perform reliably without plugging.

Figure 4:
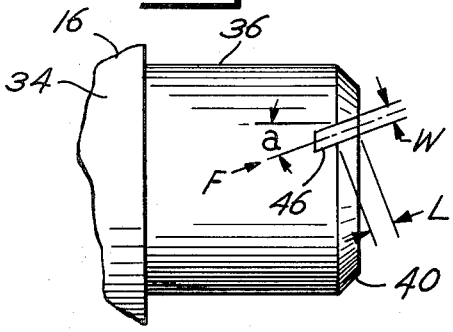
FIG. 4 is a broken side elevation view of the fluid distributor shown in FIG. 3 and showing one of the metering orifices of the invention.

The angle a of the angled passages or orifices, as shown in FIG. 4, is not critical to the present invention. The angle should not be zero, because such passage would be a straight through passage and no swirl would be imparted to the fluid. On the other hand, the angle should not be so great that the 1.5 ratio of minimum width W to minimum depth D, or vice versa, will be exceeded. An angle a of about 15°–16° is preferred.

Although two passages 42 and two passages 46 have been shown, the number of passages may be varied without departing from the principles of the present invention. However, two of each such passages are preferred. In the case of passages 42, two passages, one on each side of the larger diameter portion 34, insures even distribution of the fluid to space 44. More than two passages would be equally operative, however, more expensive to machine. In the case of passages 46, two passages are also preferred, one on each side of the tip portion 36, to insure that a uniform swirling motion is induced in the fluid in swirl chamber 28 just prior to the fluid exiting discharge orifice 26. More than two passages would require that the cross section of each of the passages would have to be further reduced to achieve the same low flow rate. Such further reduction in cross section might increase the likelihood of plugging.

It will also be understood that the embodiment of the present invention which has been described is merely illustrative of an application of the principles of the invention. Other modifications may be made by those skilled in the art without departing from the spirit and scope of the invention.

What is claimed is:

1. Means defining an orifice for the passage therethrough of fluid at low flow rates which fluid may contain solid particulates, said orifice comprising an opening which is substantially rectangular in a cross sectional plane perpendicular to the axis of the fluid flow therethrough, said opening having a ratio of minimum width to minimum depth, or vice versa, of less than approximately 1.5, the lesser of said minimum width and said minimum depth not exceeding approximately 0.2 mm., and a ratio of the length of the opening to the lesser of minimum width and minimum depth of the opening of less than approximately 2.0.

2. The means of claim 1 wherein said substantially rectangular opening is substantially square in said cross sectional plane.

3. The means of claim 1 wherein said ratio of minimum width to minimum depth, or vice versa, is approximately 1.0.

4. The means of claim 1 wherein said ratio of length to the lesser of minimum width and minimum depth is approximately 1.0.

5. The means of claim 4 wherein said substantially rectangular opening is substantially square in said cross sectional plane and said ratio of minimum width to minimum depth, or vice versa, is approximately 1.0.

6. The means of claim 1 wherein said means is a fluid nozzle including a nozzle body and fluid distributor means in said body, said fluid distributor means having a chamfered portion thereon and said nozzle body having a tapered portion of substantially complementary angled to said chamfered portion, said chamfered and tapered portions together defining said opening.

7. The means of claim 6, wherein said fluid distributor includes means for positioning said chamfered and tapered portions relative to each other to define said opening.

8. The means of claim 7, wherein said positioning means comprises a second chamfered portion on said fluid distributor means spaced upstream of the first mentioned chamfered portion and bearing against said nozzle body.

9. The means of claim 1 wherein said opening has a cross section of dimensions to pass No. 2 fuel oil at 100 psi at a flow rate which does not exceed about 0.5 gallons per hour.

10. In a fluid nozzle having a discharge orifice, a chamber for swirling fluid upstream of said discharge orifice and second orifice means for introducing said fluid into said chamber and for imparting swirl to said fluid, wherein the improvement comprises:

said second orifice means including at least one opening therein which is smaller in cross section than said discharge orifice, said opening being substantially rectangular in a cross sectional plane perpendicular to the axis of the fluid flow therethrough, said opening having a ratio of minimum width to minimum depth, or vice versa, of less than approximately 1.5, the lesser of said minimum width and said minimum depth not exceeding approximately 0.2 mm, and a ratio of the length of the opening to the lesser of minimum width and minimum depth of the opening of less than approximately 2.0.

11. The nozzle of claim 10 wherein said second orifice means includes two of said openings.

12. The nozzle of claim 10 wherein said substantially rectangular opening is substantially square in said cross sectional plane.

13. The nozzle of claim 10 wherein said ratio of minimum width to minimum depth, or vice versa, is approximately 1.0.

14. The nozzle of claim 10 wherein the last-mentioned ratio is approximately 1.0.

15. The nozzle of claim 14 wherein said substantially rectangular opening is substantially square in said cross sectional plane and said ratio of minimum width to minimum depth, or vice versa, is approximately 1.0.

16. The nozzle of claim 10 including a nozzle body and fluid distributor means in said body, said fluid distributor means having a chamfered portion thereon and said nozzle body having a tapered portion of substantially complementary angle to said chamfered portion, said chamfered and tapered portions together defining said opening.

17. The nozzle of claim 16, wherein said fluid distributor includes means for positioning said chamfered and tapered portions relative to each other to define said opening.

18. The nozzle of claim 17, wherein said positioning means comprises a second chamfered portion on said fluid distributor means spaced upstream of the first mentioned chamfered portion and bearing against said nozzle body.

19. The nozzle of claim 10 wherein said opening has a cross section of dimensions to pass No. 2 fuel oil at 100 psi at a flow rate which does not exceed about 0.5 gallons per hour.

20. A method of metering fluid which may contain solid particulates at low flow rates comprising flowing said fluid through an orifice having at least one which is substantially rectangular in a cross sectional plane perpendicular to the axis of the fluid flow therethrough, said opening having a ratio of minimum width to minimum depth, or vice versa, of less than approximately 1.5, the lesser of said minimum width and said minimum depth not exceeding approximately 0.2 mm, and a ratio of length to the lesser of minimum width and minimum depth of less than approximately 2.0.

21. The method of claim 20 wherein said substantially rectangular opening is substantially square in said cross sectional plane.

22. The method of claim 20 wherein said ratio of minimum width to minimum depth, or vice versa, is approximately 1.0.

23. The method of claim 20 wherein the ratio of the length of the opening to the lesser of minimum width and minimum depth of the opening is less than approximately 1.0.

24. The method of claim 23 wherein said substantially rectangular opening is substantially square in said cross sectional plane and said ratio of minimum width to minimum depth, or vice versa, is approximately 1.0.

25. The method of claim 24 in which the fluid is fuel oil.

26. The method of claim 20 in which the fluid is fuel oil.

27. The method of claim 20 wherein said opening is defined by a chamfered portion on a fluid distributor of a nozzle and a tapered portion on the body of the nozzle which substantially complements said chamfered portion.

28. The means of claim 20 wherein said orifice has a cross section of dimensions to pass No. 2 fuel oil at 100 psi at a flow rate which does not exceed about 0.5 gallons per hour.

* * * * *

UNITED STATES PATENT AND TRADEMARK OFFICE

CERTIFICATE OF CORRECTION

PATENT NO. : 4,360,156

DATED : November 23, 1982

INVENTOR(S) : SOTH et al

It is certified that error appears in the above-identified patent and that said Letters Patent are hereby corrected as shown below:

In Col. 1, line 14 delete "elongated" and add --elongate--.

In Col. 7, line 19 delete "angled" and add --angle--.

Signed and Sealed this

*First* Day of *March 1983*

[SEAL]

*Attest:*

GERALD J. MOSSINGHOFF

*Attesting Officer*

*Commissioner of Patents and Trademarks*